US010020626B1

(12) United States Patent
Hung

(10) Patent No.: US 10,020,626 B1
(45) Date of Patent: Jul. 10, 2018

(54) ADAPTER

(71) Applicant: Huiyang Zing Ear Industry Co., Ltd., Huizhou, Guangdong Province (CN)

(72) Inventor: Tang-Yueh Hung, Taichung (TW)

(73) Assignee: HUIYANG ZING EAR INDUSTRY CO., LTD., Huizhou (CN)

( * ) Notice: Subject to any disclaimer, the term of this patent is extended or adjusted under 35 U.S.C. 154(b) by 0 days.

(21) Appl. No.: 15/787,381

(22) Filed: Oct. 18, 2017

(51) Int. Cl.

| | |
|---|---|
| ***H01K 1/00*** | (2006.01) |
| ***H01R 33/22*** | (2006.01) |
| ***F21V 23/06*** | (2006.01) |
| ***H01R 33/94*** | (2006.01) |
| *H01R 103/00* | (2006.01) |

(52) U.S. Cl.
CPC ..... *H01R 33/22* (2013.01); *F21V 23/06* (2013.01); *H01R 33/94* (2013.01); *H01R 2103/00* (2013.01)

(58) Field of Classification Search
CPC .... H01R 33/09; H01R 13/26; H01R 13/5216; H01R 13/521
USPC ..... 439/617, 918, 699.2, 276, 936
See application file for complete search history.

(56) References Cited

U.S. PATENT DOCUMENTS

| | | | | |
|---|---|---|---|---|
| 7,306,488 | B2 * | 12/2007 | Krijne | H01R 33/06 439/617 |
| 8,226,440 | B2 * | 7/2012 | Mouchon | H01R 13/6272 439/617 |
| 9,719,638 | B1 * | 8/2017 | Wang | F21K 9/235 |
| 9,841,148 | B1 * | 12/2017 | Wang | F21K 9/235 |

* cited by examiner

*Primary Examiner* — Phuong Chi T Nguyen
(74) *Attorney, Agent, or Firm* — Guice Patents PLLC

(57) ABSTRACT

An adaptor includes: a main body, a first and a second grooves being disposed in the main body; a connection port is disposed at a bottom end of the main body, one end of the two grooves communicating with the connection port; an electrode case is connected around the main body to enclose the main body; an electrode member disposed at a top end of the main body; and a first conductive plate and a second conductive plate respectively mounted in the first and second grooves of the main body. The connection end of the first conductive plate is electrically connected with the electrode member. The connection end of the second conductive plate is electrically connected with the electrode case. The contact ends of the two conductive plates are positioned in the connection port.

10 Claims, 7 Drawing Sheets

ADAPTER

BACKGROUND OF THE INVENTION

1. Field of the Invention

The present invention relates generally to a device for transmitting current, and more particularly to an adaptor, which is easy for a user to replace a different type of lamp.

2. Description of the Related Art

It is known that an incandescent lamp (or so-called tungsten filament lamp) is one of the often seen conventional lamps. The incandescent lamp consumes pretty much power so that in the recent years, the incandescent lamp has been gradually replaced with an LED (Light Emitting Diode) lamp to save energy. However, the incandescent bulb cannot be directly replaced with the LED bulb. The main problem is that the structure and the lamp holder of the LED lamp are different from the incandescent lamp. It is necessary to change the circuit and the lamp holder so that the LED bulb can be used. Accordingly, an additional cost for changing the circuit occurs and the working time for replacing the lamp is prolonged. This is inconvenient and will lead to waste of money.

It is therefore tried by the applicant to provide an adaptor, which enables a user to conveniently and quickly replace an incandescent lamp with an LED lamp at lower cost.

SUMMARY OF THE INVENTION

It is therefore a primary object of the present invention to provide an adaptor, which enables a user to conveniently and quickly replace an incandescent lamp with an LED lamp.

It is a further object of the present invention to provide above adaptor, by which the incandescent lamp holder can be used to supply power for the LED lamp without replacing the original circuit of the incandescent lamp.

To achieve the above and other objects, the adaptor of the present invention includes:

a main body, a first groove and a second groove being disposed in the main body, a connection port being disposed at a bottom end of the main body, one end of the two grooves communicating with the connection port;

an electrode case in the form of a hollow cylindrical body, the electrode case being connected around the main body to enclose the main body;

an electrode member disposed at a top end of the main body and insulated from the electrical case; and a first conductive plate and a second conductive plate, each of the conductive plates having a connection end and a contact end, the two conductive plates being respectively mounted in the first and second grooves of the main body, the connection end of the first conductive plate being electrically connected with the electrode member, the connection end of the second conductive plate being electrically connected with the electrode case, the contact ends of the two conductive plates being positioned in the connection port.

According to the design of the present invention, when it is desired to replace an incandescent lamp with an LED lamp, the incandescent lamp holder serves as a power socket and the adaptor of the present invention serves as a power plug. Therefore, the circuit of the original incandescent lamp can be used to supply power for the LED lamp without changing the original circuit.

The present invention can be best understood through the following description and accompanying drawings, wherein:

DETAILED DESCRIPTION OF THE PREFERRED EMBODIMENTS

Figure 1:
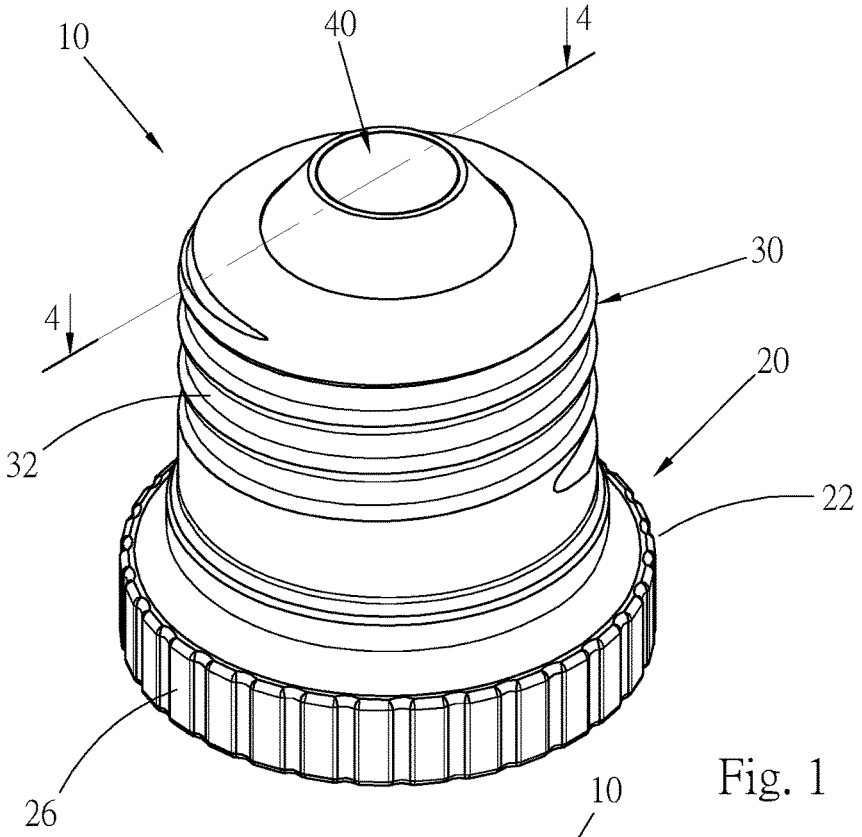
FIG. 1 is a front perspective view of a first embodiment of the adaptor of the present invention.
Figure 2:
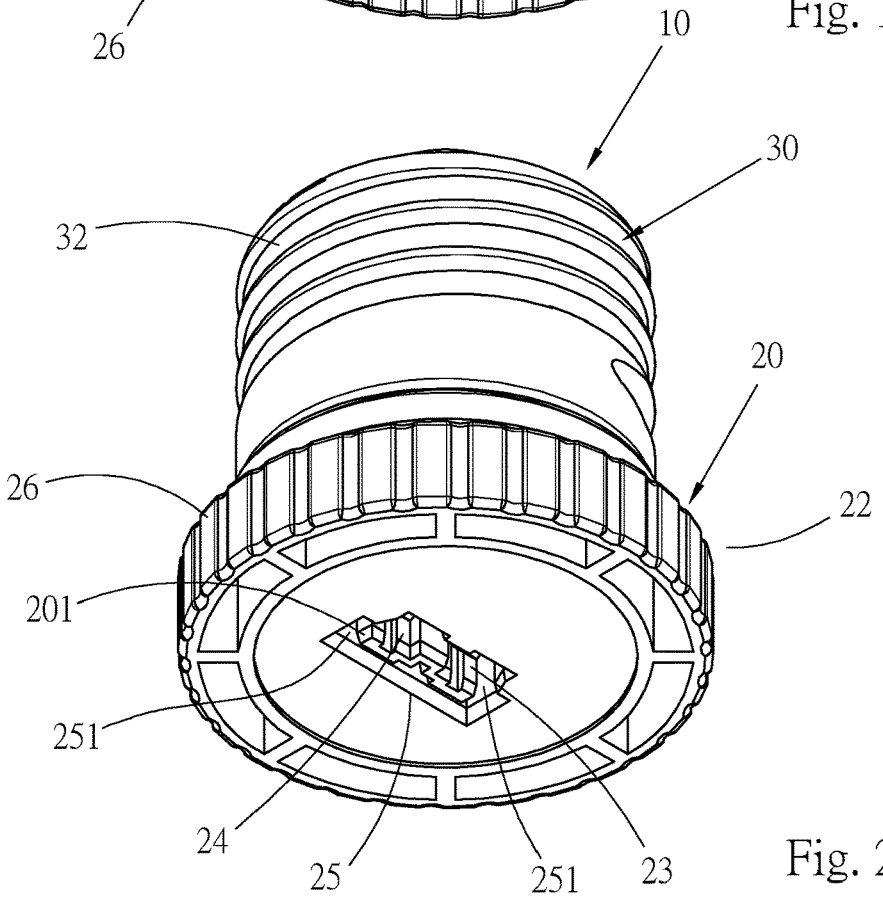
FIG. 2 is a bottom perspective view of the first embodiment of the adaptor of the present invention.
Figure 3:
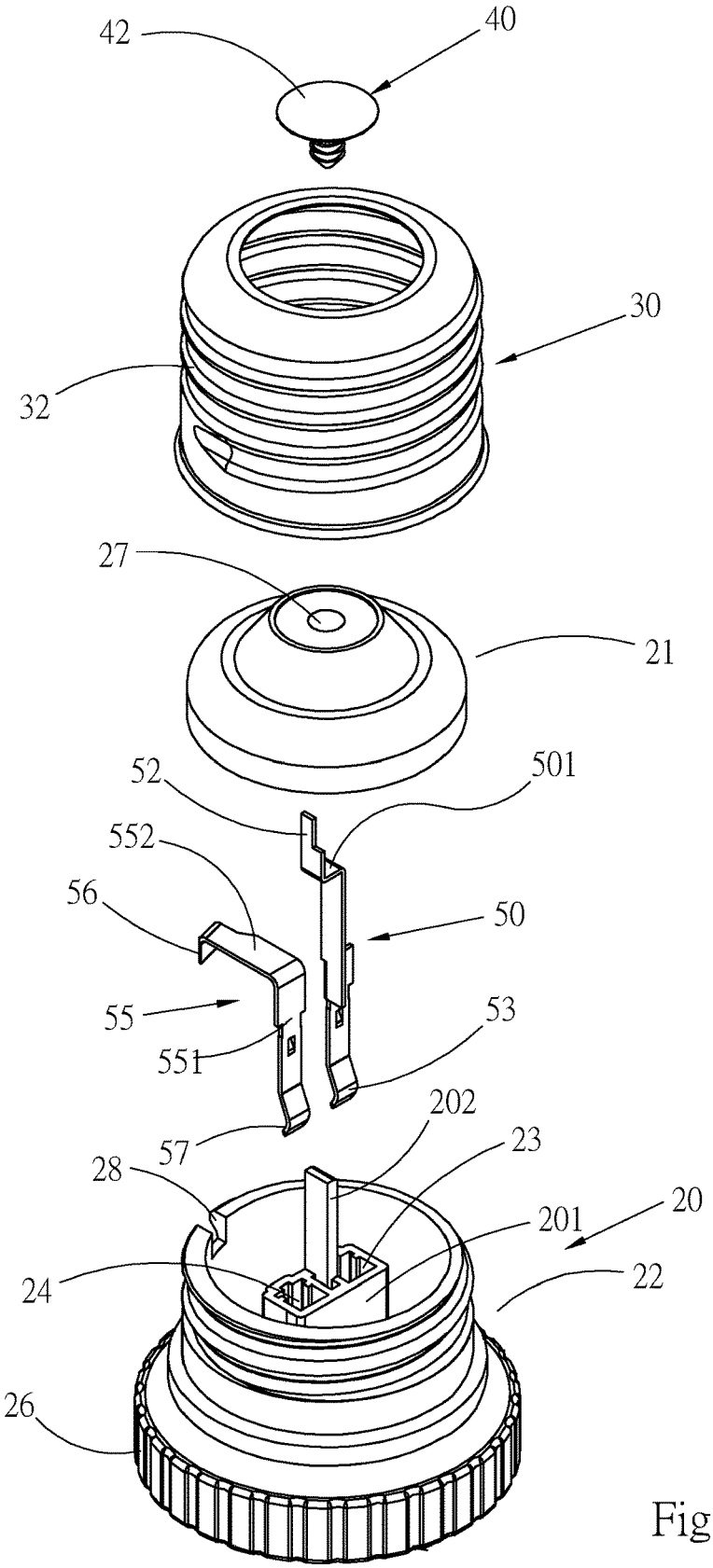
FIG. 3 is a perspective exploded view of the first embodiment of the adaptor of the present invention.

Please refer to FIGS. 1 to 3. The first embodiment of the adaptor 10 of the present invention includes a main body 20, an electrode case 30, an electrode member 40 and two conductive plates 50, 55.

Figure 4:
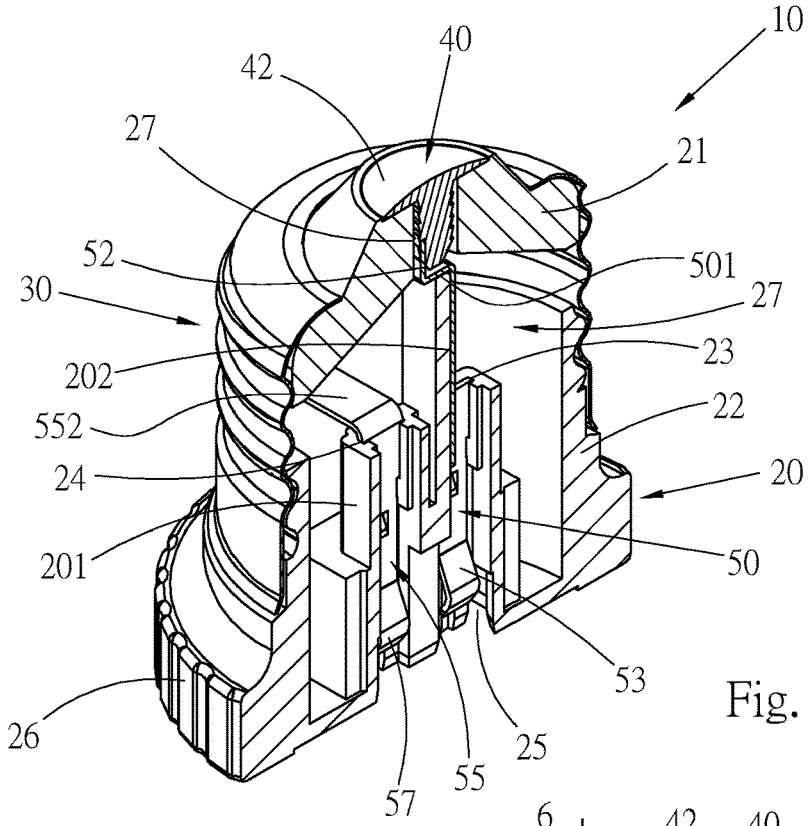
FIG. 4 is a sectional view taken along line 4-4 of FIG. 1.
Figure 5:
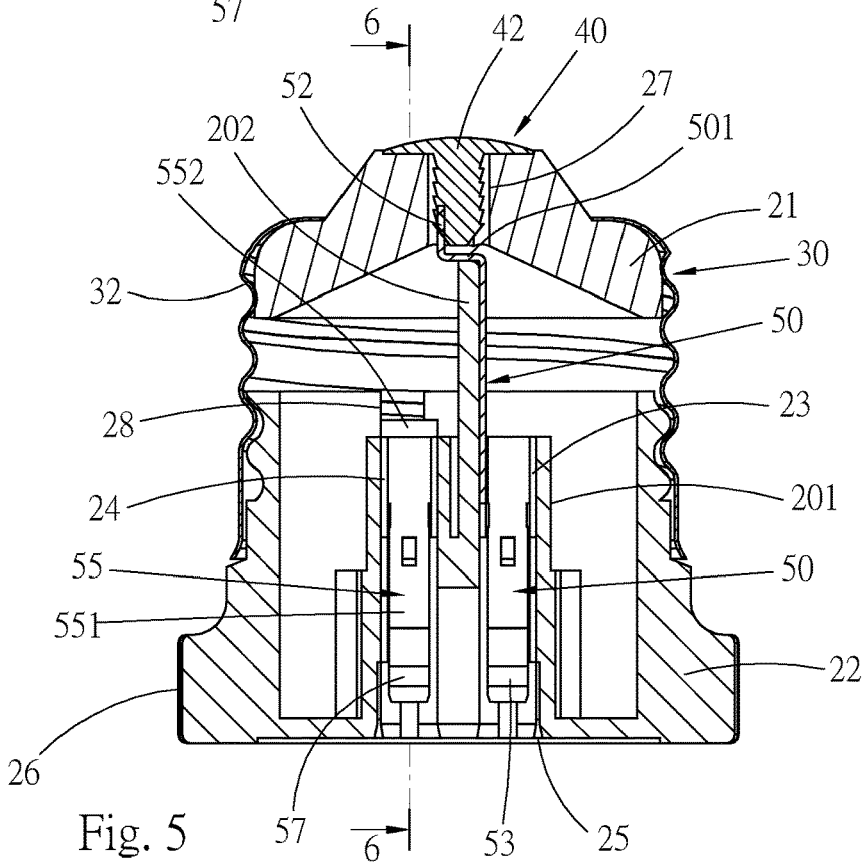
FIG. 5 is a front view according to FIG. 4.

The main body 20 is made of an insulation material. In this embodiment, the main body 20 has an upper half body 21 and a lower half body 22. The upper and lower half bodies 21, 22 are up and down arranged at an interval, whereby an interspace 27, as shown in FIG. 4, is defined between the upper and lower half bodies 21, 22 for conveniently laying the two conductive plates 50, 55. A first groove 23 and a second groove 24 are disposed in the lower half body 22. At least one groove wall 201 is positioned in the main body 20 to surround and define the two grooves 23, 24. Preferably, the two grooves 23, 24 are side by side arranged and the longitudinal direction of the two grooves 23, 24 is a direction from the top end to the bottom end of the main body 20. A column-like support section 202 upward extends from the top end of the groove wall 201 to the upper half body 21 in adjacency to the bottom end of the upper half body 21 as shown in FIGS. 4 and 5. Please refer to FIGS. 3 to 5, the lower half body 22 is formed with a connection port 25 with a specific configuration for an electrical connector to plug in. The connection port 25 is designed with a foolproof configuration, whereby the electrical connector can be only plugged into the connection port 25 in a correct direction. One end of the two grooves 23, 24 is in communication with the connection port 25. A gap 251 is defined between the connection port 25 and the groove wall 201 as shown in FIG. 2. The bottom end of the lower half body 22 has a rotary section 26 with a maximum outer diameter. A locating section 28 in the form of a recess is disposed on a circumference of the lower half body 22.

The electrode case 30 is a hollow cylindrical body with electrical conductivity. The electrode case 30 is connected around the main body 20 to enclose the main body 20. A circumference of the electrode case 30 has at least one annular connection groove, and preferably a spiral groove 32. The upper and lower half bodies 21, 22 of the main body 20 are enclosed by the electrode case 30 as shown in FIGS.

4 and 5. The rotary section 26 is not enclosed in the electrode case 30 and is exposed to outer side of the electrode case 30.

The electrode member 40 has electrical conductivity. The top end of the electrode member 40 is formed with a contact point with larger area. The electrode member 40 is mounted in a mounting hole formed on the upper half body 21 with the contact point 42 exposed to outer side of the top end of the main body 20. The electrode member 40 is not in contact with the electrode case 30 and is insulated from the electrode case 30.

Figure 6:
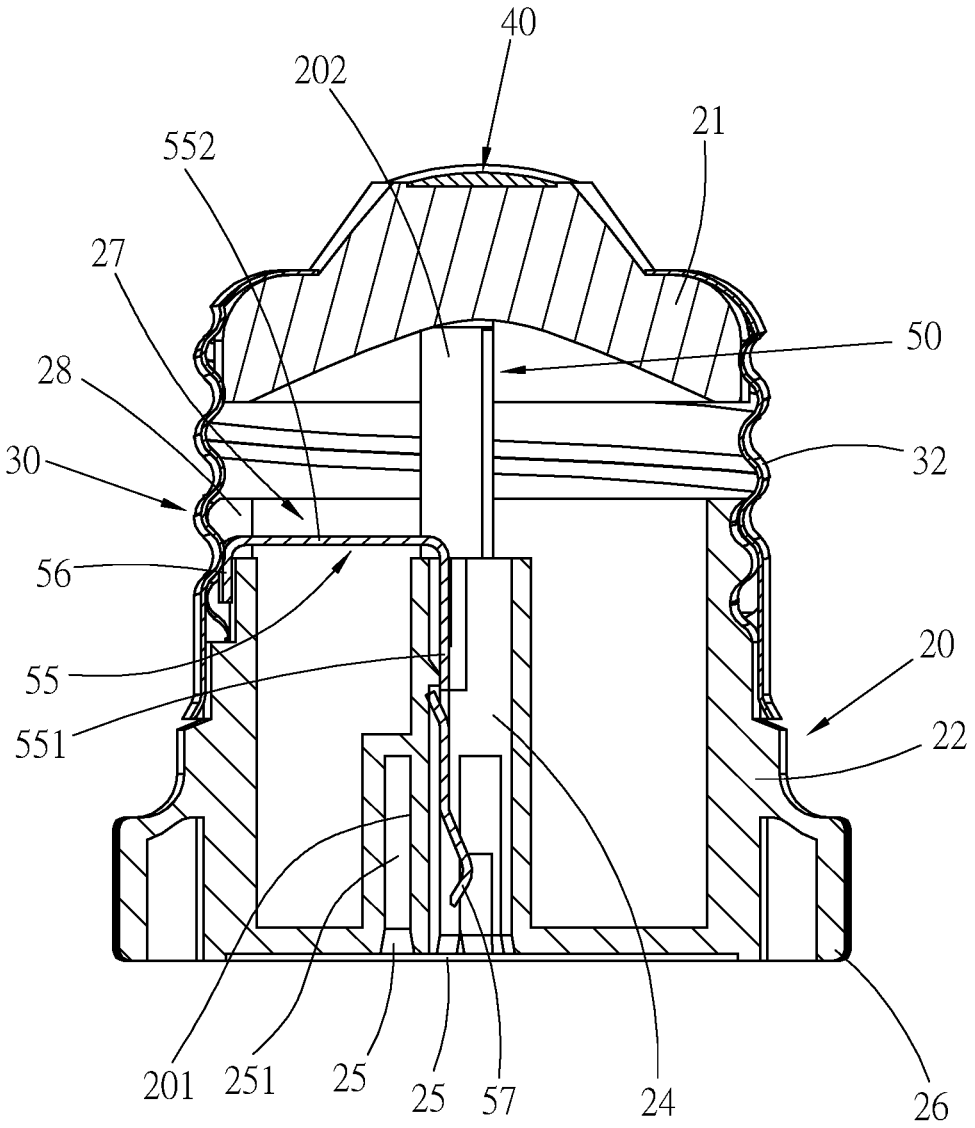
FIG. 6 is a sectional view taken along line 6-6 of FIG. 5.

The conductive plates 50, 55 are a first conductive plate 50 and a second conductive plate 55. Each of the two conductive plates 50, 55 has a connection end 52, 56 and a contact end 53, 57. The two conductive plates 50, 55 are respectively mounted in the first and second grooves 23, 24 of the main body 20. The upper plate body 501 of the first conductive plate 50 is bent and bridged over the top end of the support section 202 and supported by the support section 202. The connection end 52 is positioned at the top end of the first conductive plate 50 and is in contact with the bottom end of the electrode member 40, whereby the first conductive plate 50 is electrically connected with the electrode member 40 to conduct current. The contact end 53 is positioned at the bottom end of the conductive plate 50. The plate body of the second conductive plate 55 includes a vertical section 551 and a transverse section 552 connected with each other. The connection end 56 is disposed at one end of the transverse section 552, while the contact end 57 is disposed at the bottom end of the vertical section 551. The vertical section 551 is positioned in the second groove 24, the transverse section 552 is connected with the vertical section 551 and extends toward the outer circumference of the main body 20. As shown in FIG. 6, the connection end 56 is in contact with the electrode case 30, whereby the second conductive plate 55 is electrically connected with the electrode case 30 to conduct current. The transverse section 552 is positioned in the interspace 27 between the upper and lower half bodies 21, 22. One end of the transverse section 552 is located at the locating section 28 disposed on the circumference of the lower half body 22. The contact ends 53, 57 of the two conductive plates 50, 55 are positioned in the connection port 25.

Figure 7:
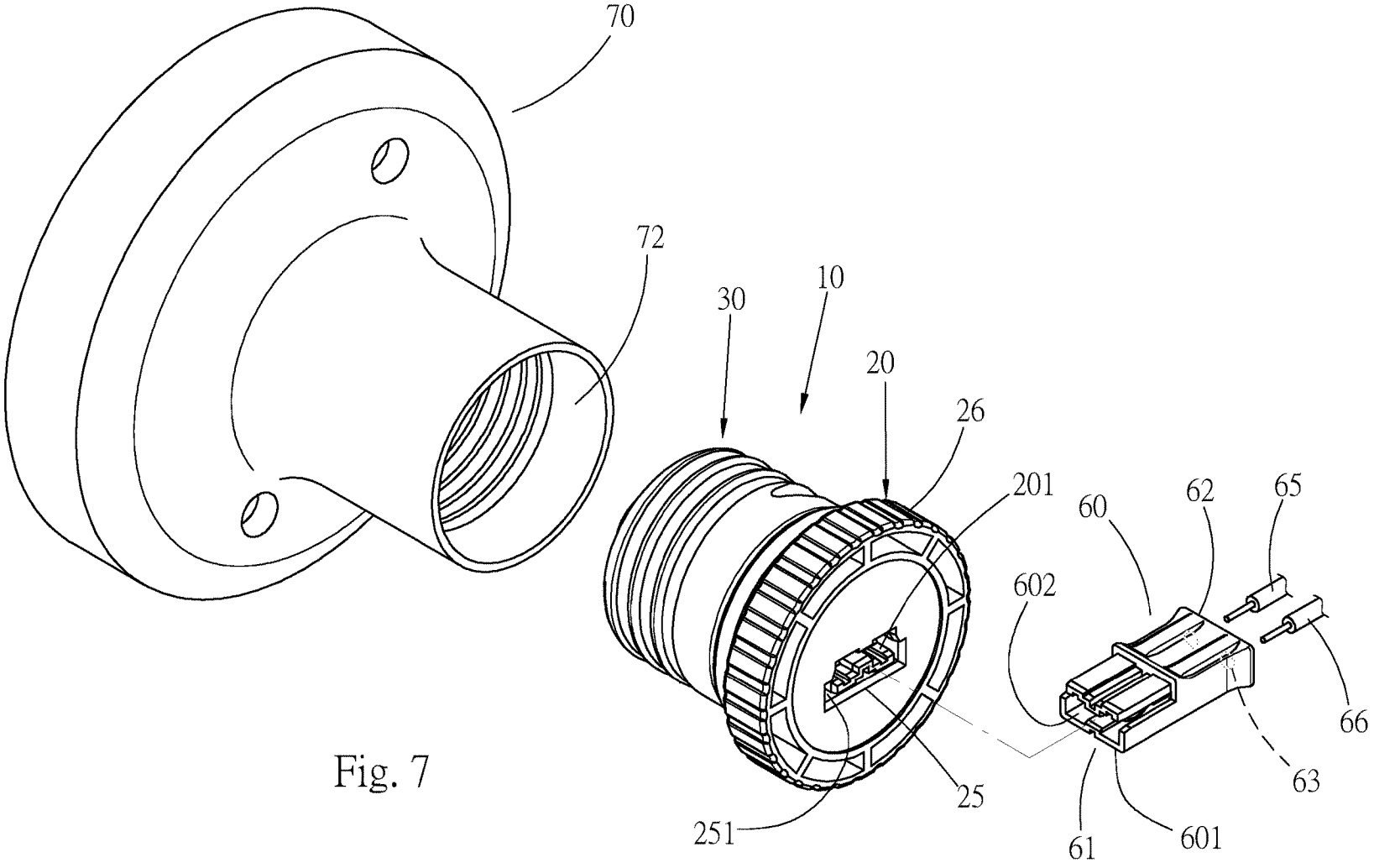
FIG. 7 is a perspective view showing the use of the adaptor of the present invention, whereby the power of the lamp holder of an incandescent lamp can be used.

The adaptor 10 of the present invention is used to replace an incandescent lamp (tungsten filament lamp) with an LED lamp. Please refer to FIG. 7, the adaptor 10 is used in cooperation with an electrical connector 60 produced by the applicant, two conductive plates (not shown) are mounted in the electrical connector. One end 61 of the electrical connector 60 is plugged into the connection port 25 of the adaptor 10 so as to electrically connect therewith. The case wall 601 of the electrical connector 60 extends into the gap 251 of the connection port 25, while the groove wall 201 of the adaptor 10 extends into a receiving groove 602 of the electrical connector 60, the two conductive plates of the electrical connector 60 are in contact with the contact ends 53, 57 of the two conductive plates 50, 55 of the adaptor 10. The electrical wires 65, 66 of the LED lamp (not shown) to be used are inserted into the electrical connector 60 from the wire insertion holes 63 formed at the other end 62 of the electrical connector 60 into contact with the two conductive plates of the electrical connector 60 respectively. The top end of the adaptor 60 is screwed into a lamp socket 72 of the incandescent lamp holder 70. Accordingly, the electrode member 40 and the electrode case 30 are respectively connected with the positive and negative electrodes of the lamp socket 72. By means of the above connection relationship, the power is transmitted from the incandescent lamp holder 70 to the two conductive plates 50, 55 of the adaptor 10 and then transmitted to the two conductive plates of the electrical connector 60 and then transmitted to the two electrical wires 65, 66 to supply power for the LED lamp. The rotary section 26 enables a user to more conveniently rotate the adaptor 10.

According to the above arrangement, when replacing the incandescent lamp with an LED lamp, it is unnecessary to uninstall or change the original circuit and the power of the original incandescent lamp holder can be directly used.

Figure 8:
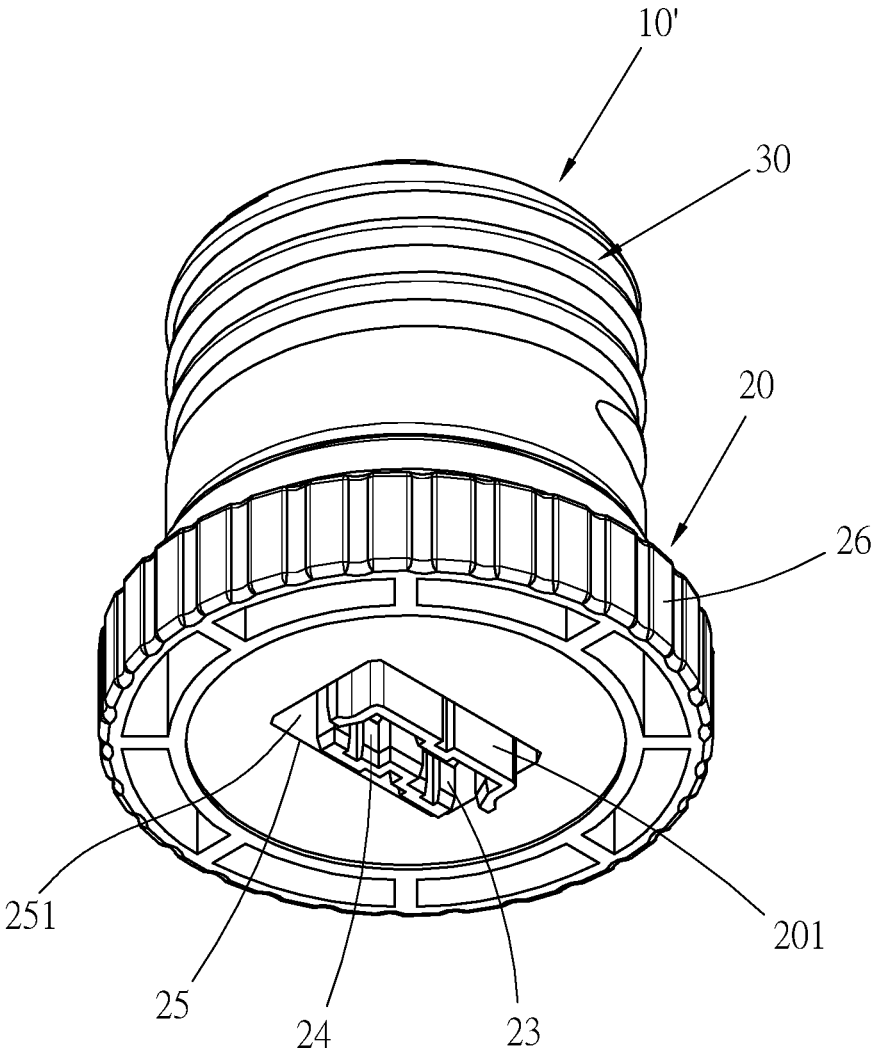
FIG. 8 is a bottom perspective view of a second embodiment of the adaptor of the present invention.

FIG. 8 shows a second embodiment of the adaptor 10' of the present invention. The adaptor 10' also includes a main body 20, an electrode case 30, an electrode member and two conductive plates. The same components are denoted with the same reference numerals and will not be redundantly described hereinafter. The structure of the second embodiment of the adaptor 10' is substantially identical to the first embodiment. The second embodiment is different from the first embodiment in that in the first embodiment, the groove wall 201 does not protrude from the connection port 25, while in the second embodiment, the connection port 25 is a rectangular opening and the bottom end of the groove wall 201 defining the first and second grooves 23, 24 protrudes from the connection port 25. In addition, a gap 251 is defined between the connection port 25 and the groove wall 201. In the second embodiment, the connection port 25 and the groove wall 201 form another type of connector for connecting with another type of electrical connector.

Figure 9:
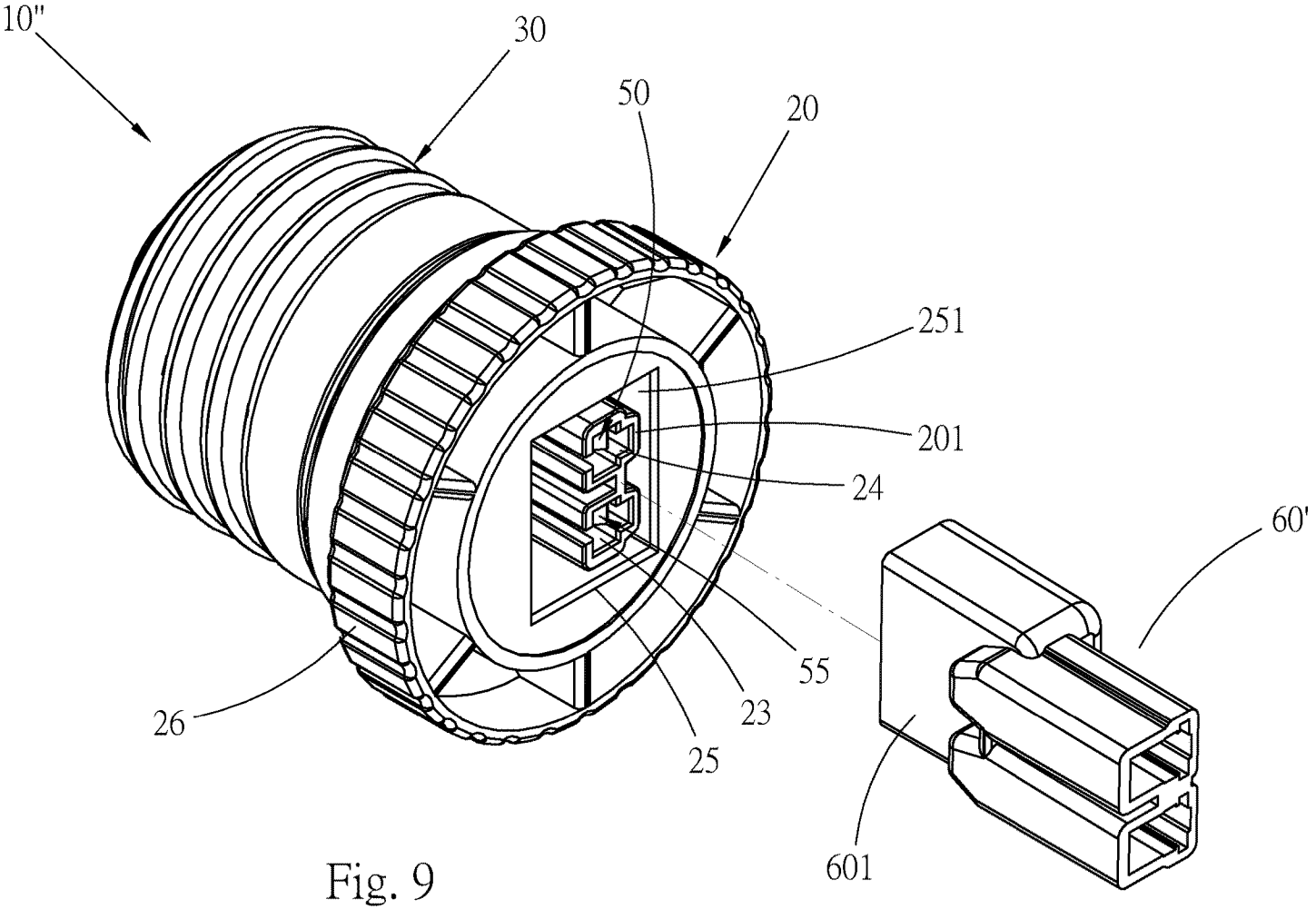
FIG. 9 is a bottom perspective view of a third embodiment of the adaptor of the present invention and an electrical connector is shown.

FIG. 9 shows a third embodiment of the adaptor 10" of the present invention. The adaptor 10" also includes a main body 20, an electrode case 30, an electrode member and two conductive plates 50, 55. The same components are denoted with the same reference numerals and will not be redundantly described hereinafter. In the third embodiment, the groove wall 201 does not protrude from the connection port 25. A gap 251 is also defined between the groove wall 201 and the connection port 25 for the case wall 601 of an electrical connector 60' to extend into. In the third embodiment, the connection port 25 and the groove wall 201 form another type of connector for connecting with another type of electrical connector 60'.

When it is desired to replace an incandescent lamp with an LED lamp, by means of the adaptor of the present invention, the replacement can be quickly completed. In the present invention, the incandescent lamp holder serves as a power socket and the adaptor serves as a power plug, therefore, the circuit of the original incandescent lamp holder can be used to supply for the LED lamp without change the original circuit. As a result, the time and cost for replacing the lamp can be saved.

In the present invention, the connection ends 52, 56 of the integrally formed conductive plates 50, 55 are in electrical contact with the electrode case and the electrode member without the design that the electrical wires are soldered with the electrode case and the electrode member. Therefore, the production rate and assembling rate of the adaptor of the present invention are very high so that the cost for the parts and the assembling can be lowered. Moreover, the conductive plates are in secure contact with the electrode case and the electrode member so that the current can be reliably transmitted.

The above embodiments are only used to illustrate the present invention, not intended to limit the scope thereof. Many modifications of the above embodiments can be made without departing from the spirit of the present invention.

What is claimed is:

1. An LED adaptor comprising:

a main body; a first groove and a second groove being disposed in the main body; a connection port being disposed at a bottom end of the main body; one end of the two grooves communicating with the connection port;

an electrode case in the form of a hollow cylindrical body, the electrode case being connected around the main body to enclose the main body, a circumference of the electrode case having at least one annular connection groove;

an electrode member disposed at a top end of the main body and insulated from the electrical case; and a first conductive plate and a second conductive plate, each of the conductive plates having a connection end and a contact end, the two conductive plates being respectively mounted in the first and second grooves of the main body, the connection end of the first conductive plate being electrically connected with the electrode member; the connection end of the second conductive plate being electrically connected with the electrode case; the contact ends of the two conductive plates being positioned in the connection port;

wherein the main body has an upper half body and a lower half body, an interspace being defined between the upper and lower half bodies; the transverse section of the second conductive plate being positioned in the interspace between the upper and lower half bodies.

2. The adaptor as claimed in claim 1, wherein at least one groove wall is formed in the main body, the groove wall defining the first and second grooves; a gap being defined between the groove wall and the connection port.

3. The adaptor as claimed in claim 1, wherein at least one groove wall is formed in the main body, the groove wall defining the first and second grooves; a bottom end of the groove wall does not protrude from the connection port.

4. The adaptor as claimed in claim 1, wherein at least one groove wall is formed in the main body, the groove wall defining the first and second grooves; a bottom end of the groove wall protrudes from the connection port.

5. The adaptor as claimed in claim 1, wherein the plate body of the second conductive plate includes a vertical section and a transverse section, the contact end of the second conductive plate being disposed at the vertical section, the connection end of the second conductive plate being disposed at the transverse section, the transverse section extending to an outer circumference of the main body, the connection end of the second conductive plate being connected with the electrode case.

6. The adaptor as claimed in claim 5, wherein the main body has an upper half body and a lower half body, the upper and lower half bodies being up and down arranged; a locating section being disposed on a circumference of the lower half body; the transverse section of the second conductive plate being located at the locating section.

7. The adaptor as claimed in claim 1, wherein the main body has an upper half body and a lower half body, the upper and lower half bodies being up and down arranged; the electrode case enclosing the upper and lower half bodies; the electrode member being disposed at a top end of the upper half body.

8. The adaptor as claimed in claim 7, wherein at least one groove wall is formed in the lower half body, the groove wall defining the first and second grooves; a support section upward extending from the groove wall to the upper half body; a plate body of the first conductive plate being supported by the support section.

9. The adaptor as claimed in claim 1, wherein a rotary section is disposed at a bottom end of the main body and exposed to outer side of the electrode case.

10. The adaptor as claimed in claim 9, wherein the rotary section is a part of the main body with a maximum outer diameter.

* * * * *